United States Patent [19]

Blanchard et al.

[11] Patent Number: 4,653,678

[45] Date of Patent: Mar. 31, 1987

[54] GANGING HOOK FOR GARMENT HANGERS

[75] Inventors: Russell O. Blanchard; Everett Duester, both of Zeeland, Mich.

[73] Assignee: Batts, Inc., Zeeland, Mich.

[21] Appl. No.: 785,062

[22] Filed: Oct. 4, 1985

[51] Int. Cl.[4] ..... A47G 25/34

[52] U.S. Cl. ..... 223/85; 223/92; 223/DIG. 4; 211/113; 211/118; 248/340

[58] Field of Search ..... 223/DIGS. 3+4, 223/85, 92, 88; 24/236, 237, 599; 211/113, 118; 16/267; 248/340

[56] References Cited

U.S. PATENT DOCUMENTS

| | | | |
|---|---|---|---|
| D 194767 | 3/1963 | Warmath | 223/DIG. 3 |
| 1,429,835 | 9/1922 | Biener | 223/DIG. 3 |
| 1,910,629 | 5/1933 | Navarte | 223/DIG. 4 |
| 2,787,435 | 4/1957 | Shields | 248/340 X |
| 3,515,319 | 6/1970 | Furtals et al. | 223/85 |
| 4,007,861 | 2/1977 | Duester et al. | 223/85 |
| 4,364,496 | 12/1982 | Bridgeman | 223/92 X |
| 4,450,639 | 5/1984 | Duester | 223/85 X |

FOREIGN PATENT DOCUMENTS

| | | | |
|---|---|---|---|
| 0144653 | 10/1984 | European Pat. Off. | 223/85 |
| 1454403 | 8/1966 | France | 223/85 |
| 2258156 | 9/1975 | France | 223/85 |

*Primary Examiner*—Werner H. Schroeder
*Assistant Examiner*—Andrew M. Falik
*Attorney, Agent, or Firm*—Price, Heneveld, Cooper, DeWitt & Litton

[57] ABSTRACT

A hanger of molded plastic body construction has an integral hook anchor for an auxiliary hanger depending from the body of the hanger below and in vertical alignment with the hanger's support hook. The hook anchor has an internal chamber defined by front, back and bottom walls. The chamber is open at both ends and has a height substantially greater than the material thickness of the auxiliary hook to be secured in it. One of the front or rear walls has a horizontal slot providing access to the chamber for the hook of the auxiliary hanger. The slot is spaced above the bottom of the chamber to create a retaining lip for a hook seated in the chamber. In addition, means are provided to restrain the hook from leaving the chamber unless the removal is intentional and forcible.

9 Claims, 6 Drawing Figures

GANGING HOOK FOR GARMENT HANGERS

FIELD OF THE INVENTION

This invention relates to garment hangers and more particularly for hangers specifically designed to serve the dual purpose of both transportation and display of the garments under situations in which more than one hanger is necessary to display the garment and to transport it, necessitating the hangers to be ganged during both transport and display.

BACKGROUND OF THE INVENTION

In the case of a number of garments, the garment consists of at least two separate pieces, each of which has to have its own support. An example of this is a coordinated blouse and skirt or slacks or pants and sweater or a dress or slacks and a jacket. In some cases, it may be desirable to transport and display two or more garments of the same design but of different colors. In all of these cases, each separate garment requires a separate hanger to support it. In many cases, the hangers may have to be of different types, such as a hanger suitable for displaying a blouse used with a hanger capable of supporting a skirt or a pair of slacks. For this purpose, it has long been a practice to utilize hanger structures in which two hangers are ganged together with one being suspended from the other. In other cases, attachments have been designed with the attachment constructed to be temporarily or permanently connected to a supporting hanger. These arrangements have not been satisfactory because they have normally required the hangers to be of such a design that they have no utility other than as ganged hangers for simultaneous multiple garment display and transport. When hangers of conventional construction have been modified to permit ganging, they have either involved difficult and complex means of attaching one garment hanger to the other or they have been unsatisfactory in transportation becuase the vibration and jostling incident to transportation causes the hangers to become disconnected, allowing one of the garments to fall to the floor or the bottom of the transport container. This same lack of security of attachment has also been a serious problem at the point of display unless the hangers are carefully handled. It is also an important requirement of any solution to this problem that the cost of the hangers must be kept as low as possible to meet the necessities of the garment manufacturing and merchandising field.

BRIEF DESCRIPTION OF THE INVENTION

In practicing the invention utilizing a garment hanger having a molded plastic body, a dependent extension of the body is provided in vertical alignment with the body's supporting hook. This dependent extension consists of front and back walls separated by a chamber having a vertical height greater than the thickness of the hook provided on the secondary hanger to be secured to the main hanger. The chamber is open at both ends and is accessible by means of a horizontal slot in the front wall of the chamber. This slot is spaced above the bottom of the chamber creating a retaining lip designed to trap the hook of the secondary or auxiliary hanger which is thereby supported from the primary hanger. The whole dependent extension is molded integral with the body of the primary hanger, eliminating all necessity for secondary parts or any sub-assembly.

DESCRIPTION OF THE PREFERRED EMBODIMENT

Figure 1:
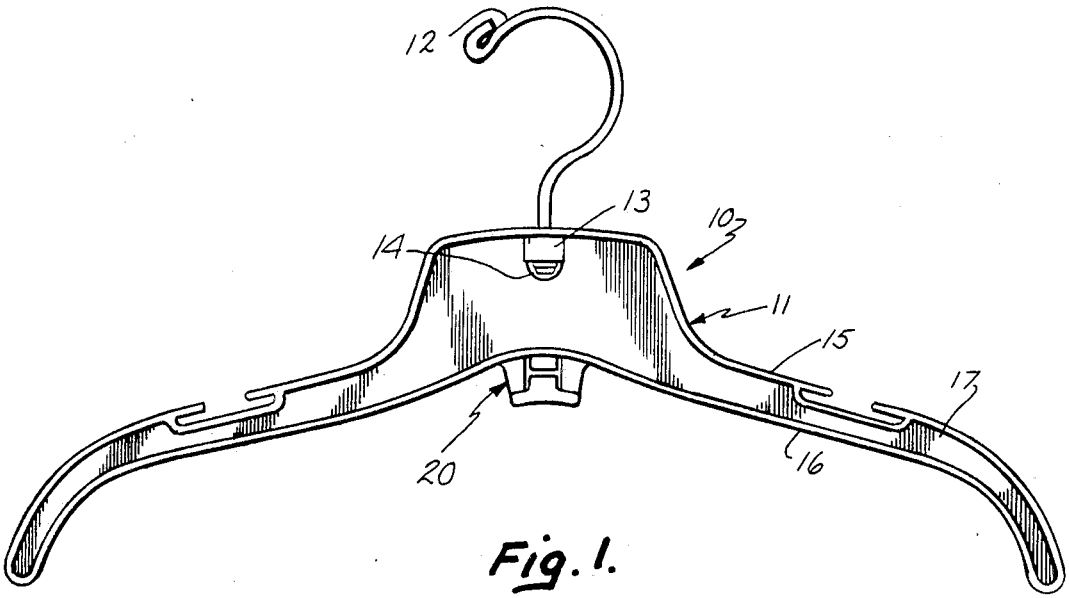
FIG. 1 is a front view of a hanger incorporating this invention.

The numeral 10 identifies a hanger having a one piece molded body 11 supported at its center from a conventional hook 12. The hook is fabricated from wire stock and is connected to the hanger by insertion into the boss 13 removal from which is prevented by the anchor clip 14. The body 11 is of the general I-beam construction having upper and lower flanges 15 and 16 joined by a vertical web 17. All of this structure is conventional, particularly, in the field of one piece, integral molded, plastic garment hangers.

Figure 3:
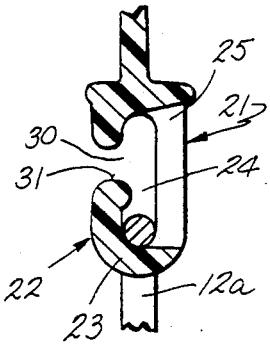
FIG. 3 is a fragmentary sectional view taken along the plane III—III of FIG. 2.
Figure 5:
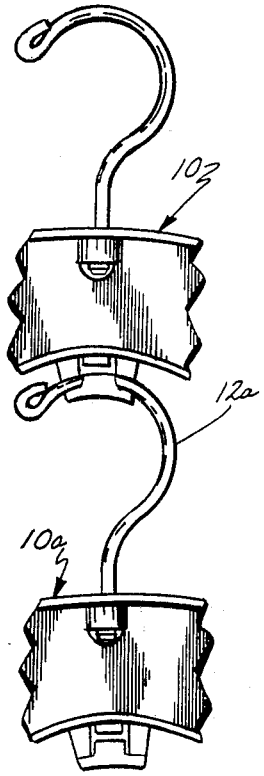
FIG. 5 is fragmentary front elevation view illustrating a pair of hangers ganged together utilizing this invention.
Figure 2:
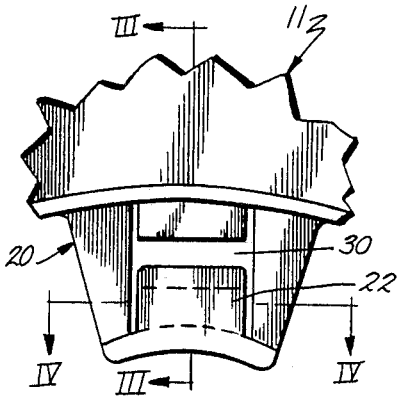
FIG. 2 is an enlarged, framgentary front view of the auxiliary hanger support of the hanger illustrated in FIG. 1.
Figure 4:
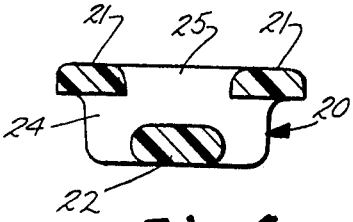
FIG. 4 is a sectional view taken along the plane IV—IV of FIG. 2.

The ganging element, which is the subject matter of this invention, is the box-like hook anchor 20 which depends from the lower flange 16 below and in vertical alignment with the support hook 12. As is best seen in FIGS. 2, 3, and 4, the auxiliary hook anchor 20 has a downwardly extending web or rear wall 21 and a front wall 22 to retain a hook. These walls are joined by a bottom wall 23 to form a generally J-shaped structure (FIG. 3) with the wall 21 forming the primary portion thereof and an upstanding lip-like portion of the front wall 22 and the bottom wall forming the reversely bent portion thereof. These walls are generally parallel and extend parallel to the longitudinal dimension of the hanger body and are spaced apart front to rear to form an internal chamber 24. This chamber has a front to rear width which is at least equal to that of the thickness of the hook **12*a* of the auxiliary hanger 10*a* which the hook anchor is designed to support. Also, the vertical height of the chamber 24 is substantially greater than that of the material thickness of the auxiliary hook 12*a* to be introduced into it. The lateral width of the front wall 22 is substantially less than that of the rear wall 21. This arrangement permits the rear wall to have an access opening 25 to permit an extension on the molding die to pass through it to form the chamber 24** and the inner face of the front wall, thus, eliminating the necessity for any movable sections in the mold used to manufacture the hanger.

The front wall 22 has a horizontal slot-like passage 30 intermediate the upper wall or dependent finger and lower walls of the internal chamber 24 and extending lengthwise of the hanger body. The vertical height of the slot 30 is such that the hook **12*a* of the auxiliary hanger 10*a* can be passed through it into the chamber 24. In a preferred construction, the front wall along the lower edge of the slot 20 has an inwardly directed lip 31** which creates a gap between the inner face of the lip and the back wall 21 which is slightly less than the thickness of the hook 12*a* of the of the auxiliary hanger. The resilience of the plastic is such that this hook may be caused to pass this lip by springing the front wall out slightly and allowing it to return to its normal position after the hook is seated in the bottom of the chamber 24. This arrangement traps the hook against unintentional displacement from the chamber both during transport and when the hangers are being handled at the point of display such as would occur while the hangers are being handled by a salesperson or a customer. At the same time, the resilience of the material is such that, if it is desired to disconnect the auxiliary hanger from the primary hanger, this can be done simply by applying enough force to cause the hook, once again, to pass the lip 31.

An alternative to providing the lip 31 would be to make the vertical height of the slot 30 slightly less than the thickness of the material of the hook whereby in order to either introduce the hook into the chamber or cause it to be removed from the chamber sufficient force has to be applied to spread the walls of the opening to allow the hok to pass through.

It will be seen that this invention provides a simple, inexpensive and positive means of ganging the garment hangers for vertical display and transport. It will be understood that the invention is not limited to simply ganging two hangers together. In fact, number of hangers can be supported in a vertical column, provided the total weight of the garments does not exceed the strength of the hook anchor 20 of the primary hanger. The invention eliminates all necesssity for any accessory part or for any assembly in the manufacture of the hanger. It, also, does not adversely affect the aesthetic appearance of the hanger, an important feature when the hangers are used for display at the point of sale. The invention does not require any change of materials from those conventionally used for hangers of this type and does not add any significant usage of material in the molding of the hanger.

Figure 6:
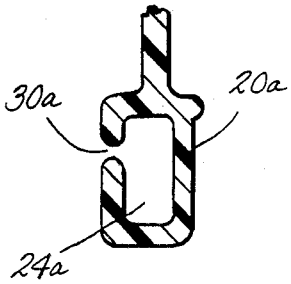
FIG. 6 is a fragmentary sectional view taken along the same plane as FIG. 3 illustrating a modified form of this invention.

FIG. 6 illustrates a modified hook anchor 20*a* in which the opening 25 through the rear wall of the hook anchor is eliminated and the chamber 24*a* is created by longitudinally movable members in the mold. While this is a more expensive approach from the standpoint of mold design and may also be more expensive in that it can increase the length of the molding cycle, there are occasions when this type of arrangment may be desirable. This Figure also illustrates the narrowed slot 30a as a substitute for the lip 31. The modification illustrated in FIG. 6 operates in a manner similar to that illustrated in FIGS. 1 through 5. It will also be recognized that while the invention has been illustrated and described with the slot 30 in the front face of the hanger, in the case of hangers wherein the front and back faces of the hanger body are different, it is entirely feasible, if so desired, to arrange the slot 30 or 30*a* in the back face of the hook anchor if the customer so desires. Such a change has no effect upon the cost of hanger manufacture or on the function of the hanger so made.

Irrespective of whether the slot is in the front or the back of the hook anchor or the hook is of the type illustrated in FIGS. 3 or 6, the hangers can be manufactured of any suitable polymer, such as styrene, ABS or polypropylene. Other polymers having the desired strength and resilience can also be used.

Having described a preferred embodiment of the invention, together with a modifcation thereof, it will be recognized that other modifications can be made without departing from the principles of the invention. Such modifications are to be considered as included in the hereinafter appended claims, unless these claims by their language expressly state otherwise.

I claim:

1. A molded plastic garment hanger having a body portion having a lower flange and a supporting hook and dependent means for engaging and suspending another hanger therefrom, said means comprising a downwardly extending web an exterior surface of which is substantially in a vertical plane tangent to the back edge of said lower flange and integral with said body portion, the lower end of said web extending forwardly and then upwardly a portion of the vertical length of the downwardly extending portion thereof to provide a hook retaining wall; a dependent finger integral with said body and aligned with the upwardly extending said hook retaining wall; an exterior surface of said hook retaining wall and finger being substantailly in a plane tangent to the front edge of said lower flange of said body, the upper end of the upwardly extending portion and the lower end of the said finger being spaced apart to form a slot of a vertical width sufficient to pass the hook of another hanger therethrough wherein said slot opens forewardly and is elongated lengthwise in the direction of the hanger body.

2. In a molded plastic garment hanger having an elongated body with a lower flange and upwardly extending support hook means between its ends for suspending it from a support, dependent means for engaging the hook of another hanger for suspending the other hanger from said body, said dependent means having a J-shaped first element and a dependent finger integral with said body spaced from said first element in a direction normal to the longitudinal axis of the body a distance sufficient to define an internal chamber to receive the hook of the other hanger therein; the first element having a primary portion and a reversely bent lower portion, the reversely bent lower portion of the first element forming the support and a portion of the internal chamber for the hook of the other hanger, the end of said finger being spaced from the upwardly extending end of the first element to form a slot extending lengthwise of the hanger and of only sufficient width to permit the hook of the other hanger to pass therethrough wherein said slot opens forewardly and is elongated lengthwise in the direction of the hanger body; all the exterior surfaces of the said dependent means being tangent with the front and back edges of said lower flange of the hanger body.

3. A molded plastic garment hanger as described in claim 2 wherein said slot is substantially midway between the top and bottom of said pocket.

4. A molded plastic garment hanger as described in claim 2 wherein said hook retaining pocket is vertically aligned with said support hook means.

5. A molded plastic garment hanger for both display and transport, said garment hanger having an elongated body of I-beam shape with upper and lower flanges and an upwardly extending support hook means between its ends for supporting the hanger from a support, dependent means for engaging and suspending the hook of another hanger from said body; said dependent means being vertically aligned with said support hook means and comprising a generally box like structure having front, back and bottom walls integral with said body, the front and back walls being spaced apart in a direction normal to the longitudinal axis of said body to form a chamber therebetween elongated parallel to the longitudinal axis of said body and of a width to receive the hook of another hanger, the exterior surfaces of said front and back walls being so spaced that they are tangent to the front and back edges of the flanges of said body, said chamber having a height substantially greater than the vertical thickness of the hook to be received therein; said chamber being centered about the central vertical plane of said body and support hook; a generally horizontal slot in the front wall of said chamber extending lengthwise of the hanger body and spaced above the bottom of said chamber to define an upwardly extending hook retaining wall.

6. The molded plastic garment hanger described in claim 5 wherein the vertical width of the slot is at least equal to that of the hook to be received in said chamber.

7. The molded plastic garment hanger described in claim 5 wherein the vertical width of the slot is less than that of the hook to be received therein and the portions of the front wall of said chamber adjacent the slot are sufficiently resilient to allow the hook to be forcibly passed therebetween for retaining the hook in the chamber against other than intentional and forceful removal therefrom.

8. The molded plastic garment hanger described in claim 5 wherein the front wall of the chamber adjacent the lower edge of the slot has an internally extending lip for retaining the hook of another hanger seated between it and the bottom of said chamber.

9. The molded plastic garment hanger described in claim 8 wherein the spacing between the inner end of said lip and the back wall of said chamber is less than the thickness of the hook received in said chamber.

* * * * *